US008143814B2

(12) United States Patent
Van Casteren et al.

(10) Patent No.: US 8,143,814 B2
(45) Date of Patent: Mar. 27, 2012

(54) METHOD AND DEVICE FOR DRIVING A GAS DISCHARGE LAMP

(75) Inventors: Dolf Henricus Jozef Van Casteren, Eindhoven (NL); Robertus Leonardus Tousain, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 418 days.

(21) Appl. No.: 12/524,381

(22) PCT Filed: Jan. 23, 2008

(86) PCT No.: PCT/IB2008/050229

§ 371 (c)(1), (2), (4) Date: Jul. 24, 2009

(87) PCT Pub. No.: WO2008/093259

PCT Pub. Date: Aug. 7, 2008

(65) Prior Publication Data

US 2010/0033098 A1 Feb. 11, 2010

(30) Foreign Application Priority Data

Jan. 30, 2007 (EP) ..... 07101382

(51) Int. Cl.
*G05F 1/00* (2006.01)

(52) U.S. Cl. ..... 315/307; 315/119

(58) Field of Classification Search ..... 315/119, 315/291, 307–309
See application file for complete search history.

(56) References Cited

U.S. PATENT DOCUMENTS

| | | | | |
|---|---|---|---|---|
| 6,144,172 | A | 11/2000 | Sun | |
| 6,894,441 | B2 | 5/2005 | Chang | |
| 7,327,101 | B1 * | 2/2008 | Chen et al. | 315/307 |
| 2003/0203699 | A1 | 10/2003 | Otsuka et al. | |
| 2006/0006813 | A1 * | 1/2006 | Van Casteren | 315/274 |
| 2010/0001649 | A1 * | 1/2010 | Yamamoto et al. | 315/119 |

FOREIGN PATENT DOCUMENTS

| | | | |
|---|---|---|---|
| WO | 9743879 | A1 | 11/1997 |
| WO | 2005074010 | A2 | 8/2005 |
| WO | 2005074331 | A1 | 8/2005 |

OTHER PUBLICATIONS

Lee et al: "Modeling and Control of Automotive HID Lamp Ballast"; IEEE Jul. 1999 International Conference on Power Electronics and Drive Systems, vol. 1, pp. 506-510.

(Continued)

*Primary Examiner* — Don Le

(57) ABSTRACT

A driver (1) for driving a gas discharge lamp (2) comprises:—a current source (3) generating lamp current, having a setpoint input (4) for receiving a setpoint signal;—a controller (10) generating a current setpoint signal (SM);—a controllable noise signal source (20) generating a pseudo random noise signal (SPRNS);—an adder (22) adding the current setpoint signal (SM) from the controller and the pseudo random noise signal (SPRNS) from the noise signal source, and providing the result to the setpoint input of the current source;—measuring means (40) measuring a characteristic lamp response of the lamp in response to the pseudo random noise signal (SPRNS), and providing to the controller a sense signal;—a memory (30) associated with the controller, having stored therein at least one reference signal. The controller compares the measured lamp response with said predetermined reference signal in the memory, and may switch off the lamp.

12 Claims, 4 Drawing Sheets

OTHER PUBLICATIONS

Anton et al: "An Equivalent Conductance Model for High Intensity Discharge Lamps"; 37TH Annual Industry Applications Conference, Oct. 2002, vol. 2, pp. 1494-1498.

Yan et al: "Nonlinear High-Intensity Discharge Lamp Model Including a Dynamic Electrode Voltage Drop"; IEEE Proceedings-Science, Measurement and Technology, vol. 150, Issue 4, Jul. 2003, pp. 161-167.

Van Casteren et al: "Improved Current Control for HID Lamp Drivers"; 40TH Annual Industry Applications Conference, Oct. 2005, vol. 2, pp. 1182-1187.

* cited by examiner

METHOD AND DEVICE FOR DRIVING A GAS DISCHARGE LAMP

FIELD OF THE INVENTION

The present invention relates in general to the field of discharge lamps, particularly High Intensity Discharge lamp (HID), i.e. high-pressure lamps, such as for instance a high-pressure sodium lamp, a high-pressure mercury lamp, a metal-halide lamp.

BACKGROUND OF THE INVENTION

Gas discharge lamps are commonly known, so an elaborate discussion of the design of a gas discharge lamp is not needed here. Suffice it to say that a gas discharge lamp comprises two electrodes located in a closed vessel filled with an ionizable gas or vapor. The vessel is typically quartz or a ceramic, specifically polycrystalline alumina (PCA). The electrodes are arranged at a certain distance from each other, and during operation an electric arc is maintained between those electrodes.

A gas discharge lamp can be powered by an electronic driver. Electronic drivers are commonly known, so an elaborate discussion of the design of electronic drivers is not needed here. In a typical design, the driver produces a commutating current that is applied to the lamp, resulting in a lamp voltage to develop over the lamp.

Drivers are typically designed to make the lamp current follow a setpoint curve, which in the simplest embodiment involves constant current magnitude; however, depending on for instance lamp type and lamp age, the driver may employ corrective current measures. Further, although gas discharge lamps have long lifetimes in the order of 10.000 hours, the lifetime of a gas discharge lamp is finite. At the end of its life, a gas discharge lamp may show undesirable properties, the most dramatic one being non-passive failure. Thus, it is desirable for the lamp driver to be able to determine lamp type and/or lamp condition, and for instance to be able to switch off a lamp if it turns out that the lamp is approaching the end of its lifetime (EOL). Further, it would be desirable to be able to predict the remaining lifetime.

International patent application WO 2005/074010 discloses a method for investigating a condition of a high-pressure gas discharge lamp. The lamp is operated with a steady-state low-frequency square-wave current signal, the frequency being 90 Hz in the disclosure, the lamp being a 100 W white HPS lamp. A short current pulse is superimposed on the steady-state current signal, the current pulse having a duration of 1.4 ms. In response to this current pulse, the lamp voltage shows a characteristic step (positive or negative) followed by a characteristic decay (negative or positive, respectively) to a substantially constant level. The characteristic decay has a characteristic decay time which can be determined, and which is described as generally varying in the range between about 1 μs and about 1.5 ms. The document describes that a faulty lamp condition, such as a too high color temperature or a too low color temperature, is correlated to the duration of the decay time, such that it is possible to determine the characteristic decay time in order to find whether the lamp property concerned, i.e. the color temperature in this example, is within or outside specification. Then, having found that a lamp property of a specific lamp is outside the operative range, it is possible to take precautionary measurements by switching off the lamp, or it is possible to change the operative conditions (the document discloses the use of additional current components) in order to change the specific lamp property concerned.

In any case, the document discloses that the lamp voltage response to a current step contains at least one parameter (i.e. decay time) that is indicative of a lamp condition or lamp property, which parameter can be measured, compared to a reference value, and corrective or protective measurements can be taken on the basis of the outcome of such comparison.

SUMMARY OF THE INVENTION

Although this known method gives satisfying results, the present invention aims to further improve this known method.

More particularly, it appears in practice that a lamp identification procedure on the basis of current step-response is hindered by noise and high-frequency disturbances. Therefore, it is a specific objective of the present invention to improve the known method such that it is more robust and more accurate in noisy circumstances.

To attain the above-mentioned objective, the present invention proposes, instead of one single current pulse, to apply a pseudo-random noise sequence of current pulses to the nominal steady-state current. The pseudo-random noise sequence is a predefined sequence; with this predefined sequence and the related system response, the system dynamics can be easily computed. It has been found in practice that this method gives more accurate results in noisy circumstances.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1A:
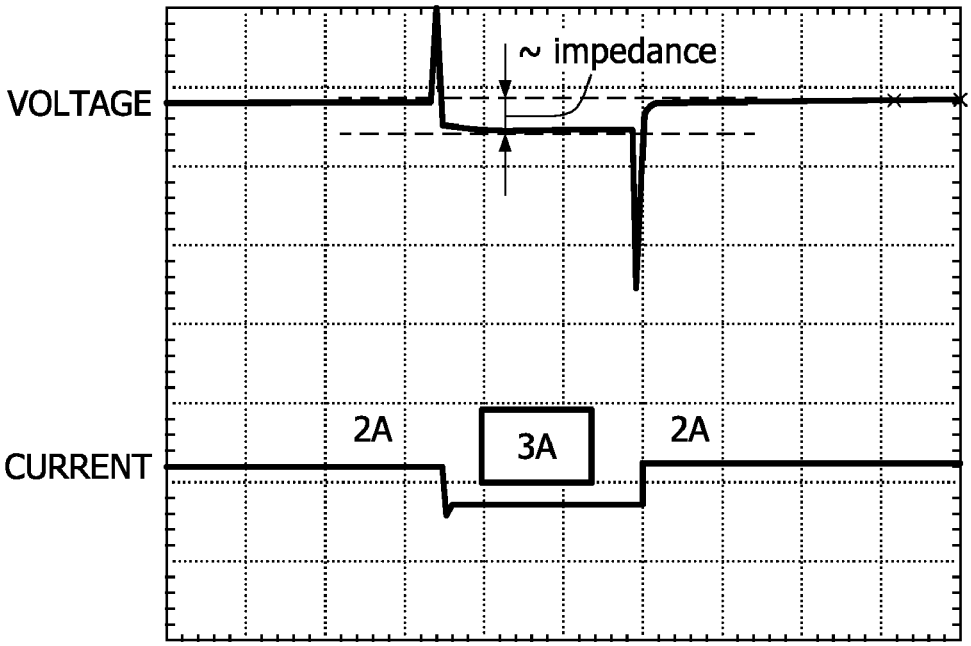
FIGS. 1A and 1B are graphs illustrating voltage response to a current step for different lamps.

FIG. 1A schematically shows graphs of lamp current (lower curve) and lamp voltage (upper curve) measured for a new 250 W gas discharge lamp having a filling with a partial pressure p(Hg)=224 bar. The current is maintained at a constant level of 2 A. At a certain time, the current is stepwise increased to a value of 3 A; as a response, the voltage rises stepwise, after which the voltage quickly drops to a value lower than the original value, thus expressing the negative impedance of the plasma. At some later time, the current is stepwise increased to the value of 2 A again; as a response, the voltage drops stepwise, after which the voltage quickly rises to the original value again.

Figure 1B:
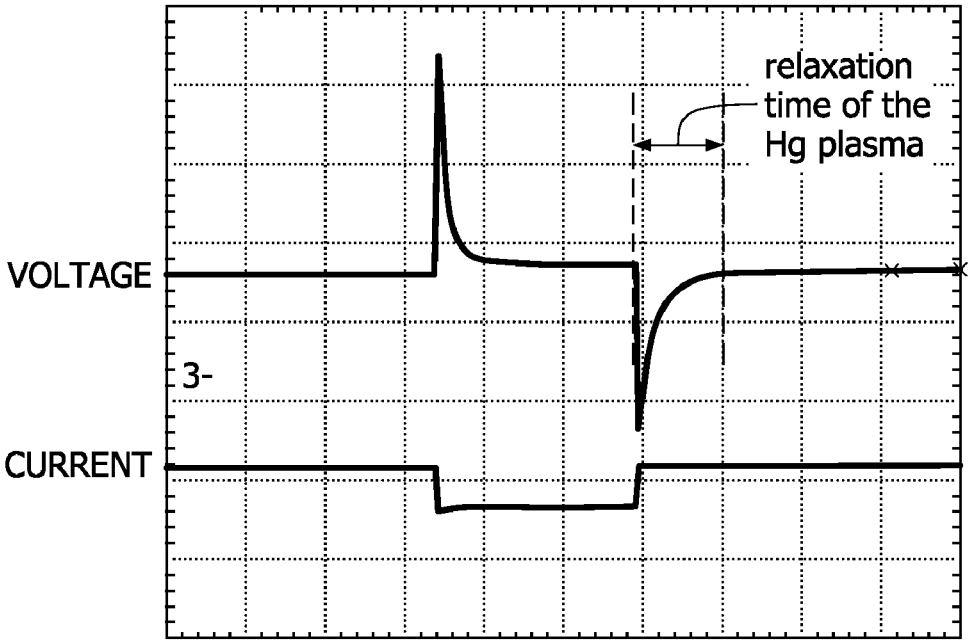

FIG. 1B shows comparable graphs, now for a lamp of the same type that has broken down, having a filling with a partial pressure p(Hg)=97 bar. In the response characteristic, it can be seen that the higher current of 3 A does not correspond to a lower voltage, and further it can be seen that the relaxation time of the plasma has increased.

Thus, the condition of the lamp (NEW or BROKEN) can be quickly determined by investigating the voltage-response to a current-step.

Figure 2:
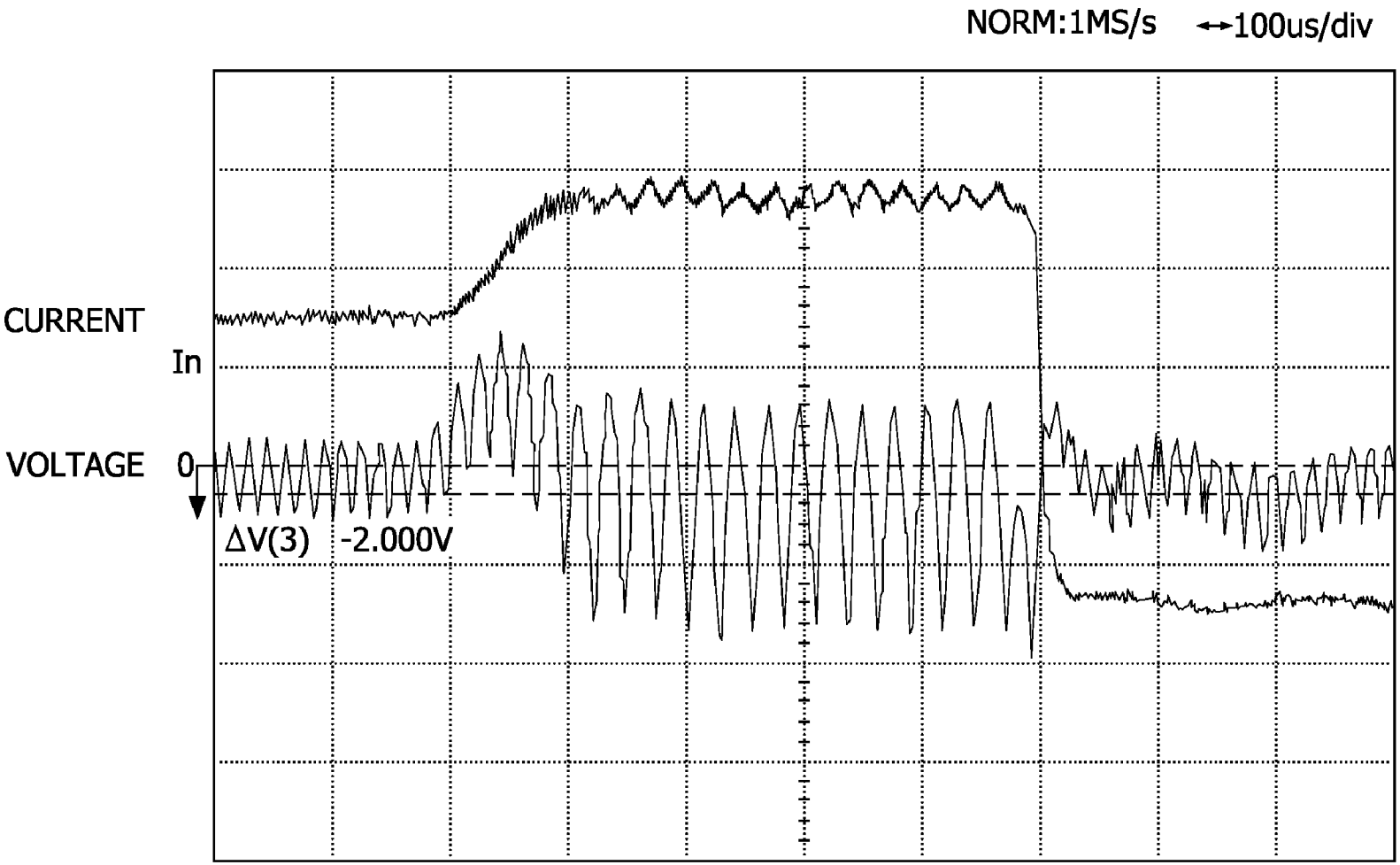
FIG. 2 is a similar graph, illustrating the influence of noise and ripple in a practical situation.

However, in practical situations, the lamp is connected in series with a switched-mode power supply, which substantially influences the measurements. For comparison, FIG. 2 shows graphs of lamp current and lamp voltage of a practical measurement for a lamp connected in series with a switched-mode power supply. It can clearly be seen that the current step results in a voltage response that practically drowns in the noise and ripple.

Figure 3A:
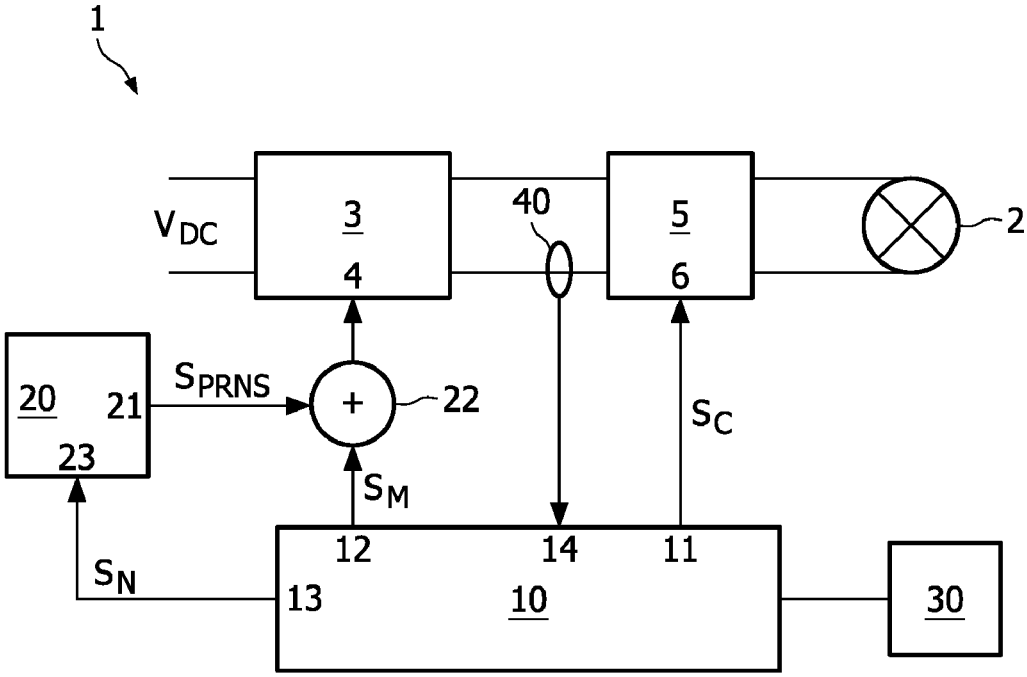
FIG. 3A is a block diagram schematically illustrating a driver according to the present invention.

FIG. 3A is a block diagram schematically illustrating a lamp driver 1 for driving a gas discharge lamp 2 according to the present invention. The driver 1 comprises a downconverter section 3 for receiving an input voltage, typically in the order of about 400 V and possibly derived from mains, and providing an output current. The downconverter section 3 has current source characteristics, meaning that it will try and maintain a constant current magnitude virtually independent of the load. The downconverter section 3 has an input 4 for receiving a control signal that determines the level of said constant current magnitude: if the control signal varies, the output current varies in a corresponding manner. The output current is applied to the lamp 2 through a bridge and igniter section 5. The bridge portion of section 5 may be half-bridge or full-bridge; since such bridge designs are known per se, further details of the bridge design is not needed here. Likewise, an igniter portion of the bridge and igniter section 5 may be of conventional design and will not be explained in more detail.

A controller 10 has a bridge output 11 coupled to a control input 6 of the bridge and igniter section 5. The controller 10 further has a converter output 12 coupled to a control input 4 of the downconverter section 3. At its bridge output 11, the controller 10 provides a commutation control signal Sc, defining commutation moments and forcing the bridge portion of section 5 to reverse the lamp current direction, as is known per se. At its converter output 12, the controller 10 provides a current control signal $S_M$, defining the magnitude of the output current of the downconverter section 3. The current control signal $S_M$ will also be indicated as a "setpoint" signal. The downconverter section 3 may comprise a feedback loop, measuring the magnitude of the output current and comparing the measured value with the command signal received at control input 4, and adapting if necessary the magnitude of the output current such that this magnitude accurately follows the command signal; such feedback loop is not shown in the figure.

Figure 3B:
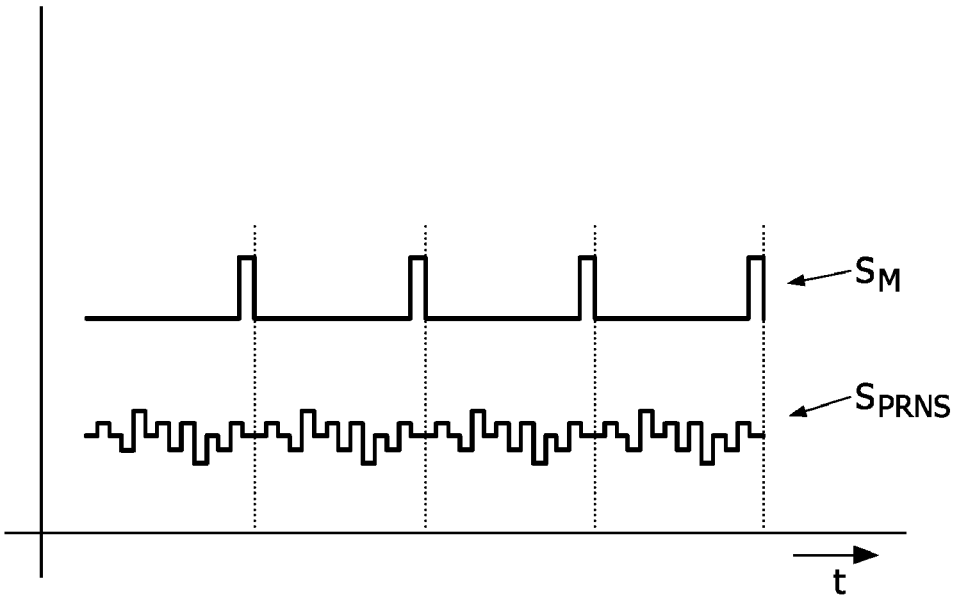
FIG. 3B is a graph schematically illustrating a current setpoint signal.

FIG. 3B shows a typical example of a suitable current "setpoint" signal $S_M$. This signal is constant (indicating constant current) during the entire waveform period, except for a brief increase just before the commutation moments (indicated by vertical dotted lines) to increase stability. For a more detailed explanation of the effect of such brief increase, reference is made to WO-00/36883.

The driver 1 further comprises a random noise source 20, having an output 21 for providing a pseudo random noise signal $S_{PRNS}$, and an adder 22, having one input receiving the random noise signal $S_{PRNS}$ from the random noise source 20, having a second input receiving the current control signal Sm from the controller 10, and having an output connected to the control input 4 of the downconverter section 3. Effectively, the downconverter section 3 receives the addition of current control signal Sm and pseudo random noise signal $S_{PRNS}$, which addition is treated as current "setpoint" signal.

It is noted that the phrase "pseudo random noise signal" is known to persons skilled in the art, so that an explanation of a "pseudo random noise signal" is not needed here. Suffice it to say that the pseudo random noise signal comprises a sequence of steps in positive and negative directions. A pseudo random noise signal $S_{PRNS}$ is also schematically illustrated in FIG. 3B. The horizontal axis of FIG. 1 represents time, the vertical axis represents signal magnitude, in arbitrary units.

It is further noted that the pseudo random noise signal $S_{PRNS}$ preferably is a noise sequence that is stored in a memory of the source 20, for instance implemented as a shift register, so that the source 20 repeatedly produces the same noise signal. This substantially simplifies the calculation of the pulse response.

It is noted that the source 20 may be an external source, as shown for clarity, but may also be implemented as part of the controller 10, in which case also the addition functionality may suitably be provided by the controller 10 itself.

The driver 1 further comprises a lamp current sensor 40, coupled to a current sense input 14 of the controller 10.

The lamp response to such pseudo random noise signal can be used to distinguish lamps. This was experimentally confirmed as follows.

In a first step, the nominal lamp current for a certain lamp was determined. This may be done by measuring the nominal lamp current during one current period, but the effect of possible noise can be attenuated by measuring the nominal lamp current during a plurality of successive current period and averaging over this plurality; in the experiment, this was done by averaging 10 measured profiles. The resulting nominal lamp current profile will be indicated as $\overline{Y}$.

In a second step, the pseudo random noise signal $S_{PRNS}$ of length Ny was added, and again the resulting lamp current profile was measured; this will be indicated as the disturbed lamp current profile $\hat{Y}$. Here, the same applies: during a plurality (10) of successive current periods, the same pseudo random noise signal $S_{PRNS}$ was added in each current period, and the resulting current profiles were averaged. In the following, the pseudo random noise signal $S_{PRNS}$ will also be indicated as V.

The noise response $\Delta Y$ of this lamp to the pseudo random noise signal $S_{PRNS}$ can be denoted as $\Delta Y=\hat{Y}-\overline{Y}$.

From V and $\Delta Y$, the Nv leading impulse response parameters of the system, $G=[G_0, G_1, \ldots G_{Nv-1}]$, can be computed by least squares optimization as follows:

$$G = (U^T U)^{-1} U^T \Delta Y, \text{ where}$$

$$U = \begin{bmatrix} V_1 & 0 & \ldots & 0 \\ V_2 & V_1 & \ldots & 0 \\ \vdots & \vdots & \ddots & \vdots \\ V_{Nv} & V_{Nv-1} & \ldots & V_1 \\ \vdots & \vdots & & \\ V_{Ny} & V_{Ny-1} & \ldots & V_{Ny-Nv+1} \end{bmatrix}$$

Figure 4:
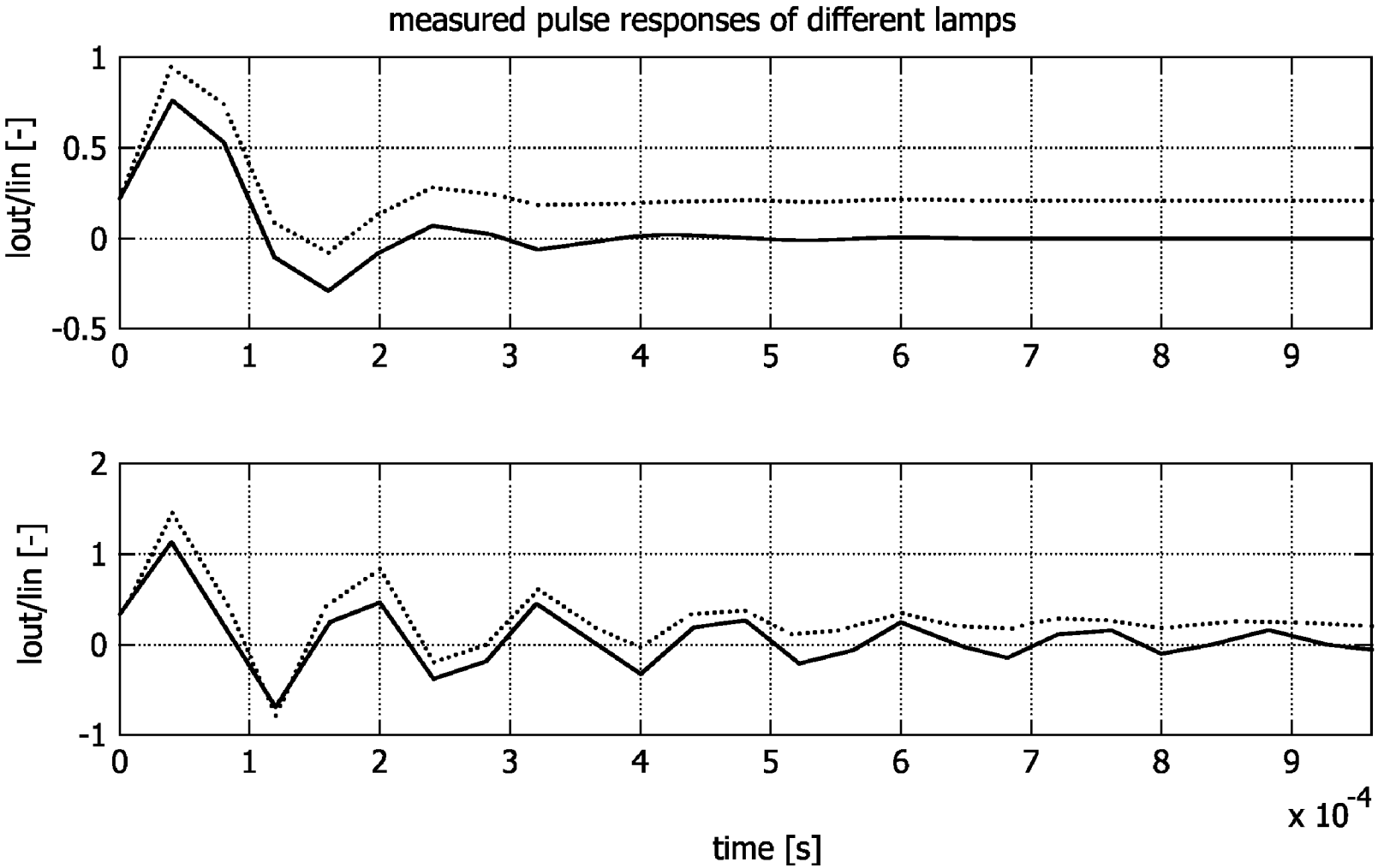
FIG. 4 is a graph schematically illustrating the calculated current response of two different lamps to a pseudo random noise signal according to the present invention.

The resulting measured impulse responses of a representative selection of two different lamps are shown in FIG. 4; the upper graph concerns an old lamp, the lower graph concerns a new lamp. The dotted lines (shifted up by 0.2 to make them distinguishable from the solid lines) represent corresponding impulse responses from the physical model. These were obtained by fitting the parameters in the equivalent electrical model to the measured data. It can be concluded that the model structure is adequate to describe the effect of lamp-ballast interaction on the lamp current dynamically.

From FIG. 4, it can also be concluded that the proposed method is suitable to distinguish different lamps. This especially applies to distinguishing new lamps and EOL lamps.

Different lamp types have different impulse responses. It is possible to determine the impulse responses of several lamp types and store those impulse responses in a memory 30 associated with the controller 10. This allows the controller 10 to measure an impulse response, compare the measured response with the information in the memory, and on the basis of this comparison determine the type of the lamp 2 currently being driven. On the basis of this determination, the controller 10 may adapt some control parameters, such as for instance the steady-state current magnitude and/or the steady-state current waveform, in conformity with the lamp type as determined. Alternatively, the controller 10 may generate a lamp type indication signal, indicating the lamp type as determined. Alternatively, the controller 10 may decide to switch off the lamp if the comparison indicates that the lamp is approaching the end of its lifetime. Alternatively, a warning signal may be issued.

It is not necessary that the impulse response is determined continuously, and therefore it is not necessary that the random noise source 20 is operating continuously. In the embodiment of FIG. 3A, the random noise source 20 has a control input 23 connected to a noise control output 13 of the controller 10, providing a noise control signal $S_N$ for switching on the random noise source 20 when required. The controller 10 may switch on the random noise source 20 for instance whenever a new lamp replaces an old lamp, in order to determine the lamp type. The controller 10 may further switch on the random noise source 20 regularly, for instance every 100 hours or every 500 hours, to determine whether the lamp still meets its specification and/or to determine whether the lamp approaches the end of its lifetime. It is noted that the noise control signal $S_N$ will also provide synchronization for the pseudo random noise signal with the current setpoint signal.

It is noted that, whenever the controller 10 switches on the random noise source 20, the random noise source 20 produces the same pseudo random noise signal in subsequent current periods, not necessarily successive current periods. The duration of the measurement, i.e. the duration of the noise disturbance, therefore lasts a few seconds at the most.

For each current step of the pseudo random noise signal, it is preferred that the size of such step is small (in the order of 1 to 3% of the nominal current setpoint) in order not to disturb the nominal current setpoint too much. The number of current pulses of the pseudo random noise signal in each current period is not critical. In general, it can be said that the higher this number, the smaller noise influences on the eventual result are. A too high number may be considered to be unpractical. Although a number as low as two already provides an improvement over prior art with only one current step, a number in the range from 10 to 50 is preferred. In the experiments described above, the number of current pulses of the pseudo random noise signal was equal to 30.

Summarizing, the present invention provides a driver 1 for driving a gas discharge lamp 2, comprising:

- a current source 3 for generating lamp current, having a setpoint input 4 for receiving a setpoint signal;
- a controller 10 having an output 12 for generating a current setpoint signal $S_M$;
- a controllable noise signal source 20 controlled by the controller 10, designed for generating a pseudo random noise signal $S_{PRNS}$;
- an adder 22 connected to receive the current setpoint signal $S_M$ from the controller 10 and the pseudo random noise signal $S_{PRNS}$ from the noise signal source 20, and having an output coupled to the setpoint input 4 of the current source 3;
- measuring means 40 for measuring a characteristic lamp response of the lamp 2 in response to the pseudo random noise signal $S_{PRNS}$, coupled to a sense input 14 of the controller 10 for providing to the controller 10 a sense signal representing the characteristic lamp response;
- and a memory 30 associated with the controller 10, having stored therein at least one reference signal.

The controller 10 is designed to compare the characteristic lamp response as measured by the measuring means 40 with said predetermined reference signal in the memory 30.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, the controller 10 and the random noise source 20 may be integrated as one device. The same applies to the controller 10 and the memory 30.

Further, in the above description a method has been described where the current response to current noise is taken into account. Alternatively, or additionally, it is also possible to monitor the lamp voltage response to noise in the current setpoint signal.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Driver (1) for driving a gas discharge lamp (2), comprising:

- a current source (3) for generating lamp current, having a setpoint input (4) for receiving a setpoint signal;
- a controller (10) having an output (12) for generating a current setpoint signal ($S_M$);

a controllable noise signal source (20) controlled by the controller (10), designed for-generating a pseudo random noise signal ($S_{PRNS}$);

an adder (22) connected to receive the current setpoint signal ($S_M$) from the controller (10) and the pseudo random noise signal ($S_{PRNS}$) from the noise signal source (20), and having an output coupled to the setpoint input (4) of the current source (3);

measuring means (40) for measuring a characteristic lamp response of the lamp (2) in response to the pseudo random noise signal ($S_{PRNS}$), coupled to a sense input (14) of the controller (10) for providing to the controller (10) a sense signal representing the characteristic lamp response;

a memory (30) associated with the controller (10), having stored therein at least one reference signal;

wherein the controller (10) is designed to compare the characteristic lamp response as measured by the measuring means (40) with said predetermined reference signal in the memory (30).

2. Driver according to claim 1, wherein the measuring means (40) comprises a current sensor for measuring lamp current.

3. Driver according to claim 1, wherein the measuring means (40) comprises a voltage sensor for measuring lamp voltage.

4. Driver according to claim 1, wherein the pseudo random noise signal ($S_{PRNS}$) contains, for one lamp current period, a series of subsequent current pulses, wherein the number of current pulses in said series is at least equal to 2 or more, preferably in the range from 10 to 50, most preferably in the order of about 30.

5. Driver according to claim 1, wherein the noise signal source (20) is controlled by the controller (10) for generating the pseudo random noise signal ($S_{PRNS}$) in synchronization with the current setpoint signal ($S_M$), such that, for different current periods, the corresponding pseudo random noise signals ($S_{PRNS}$) are mutually equal.

6. Driver according to claim 5, wherein the controller (10) is designed to average the lamp response over a plurality of lamp current periods, said plurality preferably comprising in the order of about 10 current periods.

7. Driver according to claim 1, wherein the controller (10) is designed, if the results of said comparison indicate that the lamp (2) approaches the end of its lifetime, to generate an end-of-life indication signal.

8. Driver according to claim 1, wherein the controller (10) is designed, if the results of said comparison indicate that the lamp (2) approaches the end of its lifetime, to switch off the lamp (2).

9. Driver according to claim 1, wherein the controller (10) is designed, on the basis of the results of said comparison, to adapt at least one control parameter.

10. Driver according to claim 9, wherein said control parameter to be adapted includes the steady-state current magnitude and/or the steady-state current waveform.

11. Driver according to claim 1, wherein the controller (10) is designed, on the basis of the results of said comparison, to generate a lamp type indication signal.

12. Driver according to claim 1, wherein the controller (10) is designed to switch on the noise signal source (20) after replacement of a lamp, and/or regularly at intervals corresponding to a predetermined duration of operative life, for instance every 100 hours of lamp operation.

* * * * *